US006878018B2

(12) United States Patent
Miyakawa et al.

(10) Patent No.: US 6,878,018 B2
(45) Date of Patent: Apr. 12, 2005

(54) ELECTRICAL CONNECTOR

(75) Inventors: Tomoyuki Miyakawa, Shizuoka (JP); Naoto Sugie, Shizuoka (JP); Seiji Kozono, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/334,723

(22) Filed: Jan. 2, 2003

(65) Prior Publication Data

US 2004/0132351 A1 Jul. 8, 2004

(51) Int. Cl.[7] ..... H01R 13/514
(52) U.S. Cl. ..... 439/752; 439/436; 439/595
(58) Field of Search ..... 439/752, 426, 439/59, 436

(56) References Cited

U.S. PATENT DOCUMENTS 6,435,919 B1 * 8/2002 Saka et al. ..... 439/752
6,527,583 B2 * 3/2003 Plate ..... 439/489

FOREIGN PATENT DOCUMENTS

JP 2000-252000 9/2000

* cited by examiner

*Primary Examiner*—Truc Nguyen
(74) *Attorney, Agent, or Firm*—Armstrong, Kratz, Quintos, Hanson & Brooks, LLP

(57) ABSTRACT

An engagement portion 24 of a locking member 5, which is inserted through a locking member insertion hole 10 into a connector housing 2, is engaged with the connector housing 2. Additionally, a connector terminal 4 accommodated in a connector housing 2 is locked with the locking member 5. The locking member 5 includes a pair of fitting pieces 12, each of which is provided with said engagement portion 24 and supported resiliently. An engagement release tool 27 is inserted into the connector housing 2 through an engagement release hole 25 provided on the connector housing 2. Then, the engagement release tool 27 deflects the fitting piece 12 to release an engagement of the engagement portion 24 of the fitting piece 12 with the connector housing 2.

9 Claims, 4 Drawing Sheets

ELECTRICAL CONNECTOR

BACKGROUND OF THE INVENTION

1. Field of the Invention

The present invention relates to an electrical connector in which a locking member locks an electrical connector terminal accommodated in a housing body.

2. Description of the Related Art

In vehicles or the like, a wide variety of electrical connectors are used to connect wire harnesses electrically. There is one of those electrical connectors to lock an electrical connector terminal accommodated in a terminal accommodating chamber with a spacer as a locking member.

For a concrete example, there is an electrical connector disclosed in Japanese Non-examined Patent Publication No. 2000-252000. In such an electrical connector, the electrical connector terminal is accommodated into the connector housing from a rear side thereof, and the spacer (retainer) is inserted into the connector housing through a spacer insertion hole provided on a side wall thereof. A removal prevention portion of the inserted spacer engages the connector terminal to lock the connector terminal.

The spacer has a pair of holding pieces in addition to the removal prevention portion. Each of the pair of holding pieces is connected through a connecting portion, of which an end is plate-shaped, and has a substantially horseshoe section resiliently. When attaching to the connector housing, the spacer is so located as to sandwich a housing body from above and below.

A locking groove for engaging a locking projection of the housing body is provided on each opposite face of the pair of holding pieces. When the spacer is inserted into the connector housing and the removal prevention portion of the spacer engages the connection terminal, the spacer is to be locked.

Now, in the above-described connector, the spacer is inserted into the connector housing, being attached thereto to lock the connection terminal. In detaching the spacer inserted into the connector housing, for example, suppose that the connector housing comprises the housing body which accommodates the connection terminals in a longitudinal direction of the housing body and a hood portion with open front surrounding the connector housing with a specific space. Additionally, the spacer is inserted through the side wall of the housing body and attached thereto. In this case, an end portion of an ejecting tool is inserted into a space between the hood portion and the housing body in a longitudinal direction of the housing body to engage with an ejecting portion provided in a middle of a connecting portion of the spacer. After engaging, the end portion of the ejecting tool is shifted toward a rear side of the direction of the spacer insertion to release the engagement of the spacer with the housing body and eject the spacer.

However, an object of the space between the hood portion and the housing body is to connect to the other connector electrically by means of, for example, fitting another connector housing into the space. Thus if the space is too narrow to insert the ejecting tool and shift it toward a rear side in a direction of the spacer insertion, it is difficult to release the engagement between the spacer and the housing body.

SUMMARY OF THE INVENTION

The present invention has been accomplished to solve the above-described problems and an object of the present invention is to provide an electrical connector that allows releasing an engagement of a spacer with a connector body easily.

In order to attain the above-described object, there is provided, according to a first aspect of the present invention, an electrical connector comprising a locking member being inserted through a locking member insertion hole into a connector housing, an engagement portion of the locking member engaging the connector housing, and the locking member locking a connector terminal accommodated in said connector housing. Additionally, the locking member has a fitting piece that is provided with the engagement portion and supported resiliently, and the connector housing is provided with an engagement release hole. An engagement release tool is inserted in a direction opposite to a direction of locking member insertion through the engagement release hole and deflects the fitting piece for releasing the engagement of the engagement portion with the connector housing.

In this configuration, for releasing the engagement of the connector housing with the locking member, the engagement release tool is inserted through the engagement release hole, deflecting the fitting piece to release the engagement of the engaging portion of the fitting piece with the connector housing. Thus, since the engagement release tool is inserted in the opposite direction of a locking member insertion direction, the engagement release tool reliably abuts against the fitting piece. Additionally, since the fitting piece engaged is directly abutted against the engagement release tool and deflected through no other members, the engagement of the spacer is released easily.

Preferably, an end portion of the engagement release tool is inserted into a clearance between a wall end portion of the fitting piece at the engagement portion installation side and the connector housing for deflecting the fitting piece in order to release the engagement.

Thus, the end portion of the engagement release tool is inserted into a clearance between the fitting piece and the connector housing and deflects the fitting piece to release the engagement. Thus, it is possible to release the engagement of the spacer in a simple structure.

Preferably, an inclined portion is provided at the end portion of the fitting piece for forming a space when the fitting piece is engaged with the connector housing. Through the space, the end portion of the engagement release tool can be inserted into a clearance between the end portion of the fitting piece and the connector housing.

In this configuration, the end portion of the engagement release tool is inserted easily between the fitting piece and the connector housing. Thus, it is possible to release the engagement of the spacer easier.

Preferably, the fitting piece is provided with an abutting portion. The end portion of abuts against the abutting portion. Thus, the engagement release tool shifts the locking member toward a rear side in the direction of the locking member insertion, after the end portion thereof having been inserted into a clearance between the fitting piece and the connector housing for releasing the engagement.

In this configuration, when the end portion of the engagement release tool is inserted into the inclined portion of the fitting piece, the fitting piece is deflected and the engagement is released, then the end portion of the engagement release tool abuts against the abutting portion of the fitting piece. Then, when the engagement release tool is inserted further, the spacer is shifted toward the rear side in the direction of the insertion with abutting against the abutting portion to be ejected. Thus, it is possible to eject the spacer easily.

Preferably, the engagement release tool is provided with an abutting portion against which the end portion of said fitting piece abuts to shift the locking member toward a rear side in the direction of the locking member insertion, after the end portion of the fitting piece has been inserted into a clearance between the fitting piece and the connector housing for releasing the engagement.

In this configuration, when the end portion of the engagement release tool is inserted into the inclined portion of the fitting piece, the fitting piece is deflected to release the engagement and the end portion of the fitting piece abuts against the abutting portion of the engagement release tool. Then, when the engagement release tool is inserted further, the spacer is shifted toward the rear side in the direction of the insertion with abutting against the abutting portion to be ejected from the connector housing. Thus, it is possible to eject the spacer easily.

Preferably, the connector housing is provided with an extrusion hole, through which an extrusion tool inserted in a direction opposite to the direction of the locking member insertion to shift the locking member toward a rear side in the direction of insertion.

In this configuration, the engagement release tool is inserted into the engagement release hole and the end portion of the engagement release tool deflects the fitting piece to release the engagement. Then, when the extrusion tool is inserted into the extrusion hole to shift the locking member toward the rear side of the direction of the insertion, the spacer is ejected from the connector housing. Thus, it is possible to eject the spacer easily.

Preferably, the connector housing comprises a housing body with a rectangular section and a hood portion. The housing body accommodates the connector terminals. The housing body is provided with a locking portion on each of two outer walls thereof. The housing body has a guide groove. The locking portion engages with an engagement portion of the locking member. The guide groove is formed on the outer walls substantially orthogonal to a direction of accommodating the connection terminal . The hood portion surrounds the housing body with a specified interval. Additionally, the locking member is composed of a pair of fitting pieces and a connecting portion, forming a substantially horseshoe-shape section. Each of the pair of fitting pieces is provided with the engagement portion and a guide piece on each opposite surface thereof. The guide piece is inserted into and guided through the guide groove. The connecting portion connects with the pair of fitting pieces resiliently and respectively. Additionally, engagement release holes are provided in the hood portion respectively at a front side of the guide groove in the direction of the locking member insertion in order to insert the engagement release tool thereto. The engagement release tool is inserted into the guide groove and the end portion of the engagement release tool is guided between the end portion of the guide piece and the housing body.

In this configuration, the guide groove guides the end portion of engagement release tool between the end portion of the guide piece and a bottom wall of the guide groove. Thus, the end portion of the engagement release tool is inserted reliably between the end portion of the guide piece and a bottom wall of the guide groove. Thus, it is possible to release the engagement of the spacer easier.

Preferably, a connecting portion of the locking member is provided with a terminal locking portion extending substantially in parallel with the pair of fitting pieces, including a locking piece to lock the connector terminal. Additionally, the housing body is provided with a through hole to insert the terminal-locking portion. Additionally, the hood portion at a front side in a direction of the terminal locking member insertion through the through hole is provided with an extrusion hole through which an extrusion tool is inserted. The extrusion tool abuts against the end portion of the terminal locking portion, shifting the terminal locking portion toward the rear side in the direction of the insertion, while being inserted into the through hole.

In this configuration, the engagement release tool is inserted into the engagement release hole and the end portion of the engagement release tool deflects the fitting piece to release the engagement. Then, when the extrusion tool is inserted into the extrusion hole to shift the locking member toward the rear side of the direction of the insertion thereof through the terminal locking portion, the spacer is ejected from the connector housing. Thus, it is possible to eject the spacer easily.

DESCRIPTION OF THE PREFERRED EMBODIMENT

Figure 1:
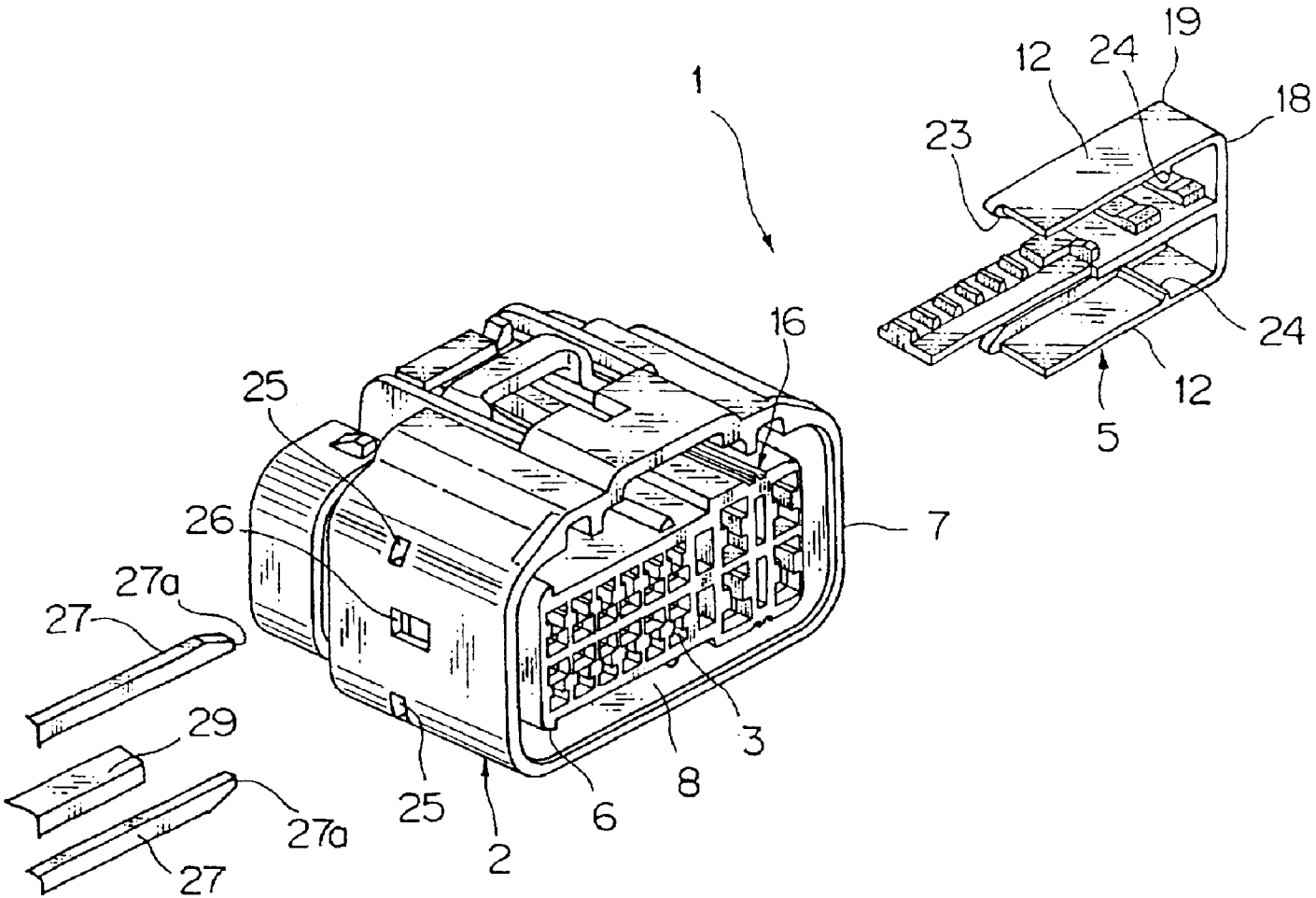
FIG. 1 is a perspective view showing an electrical connector according to the present invention.
Figure 3:
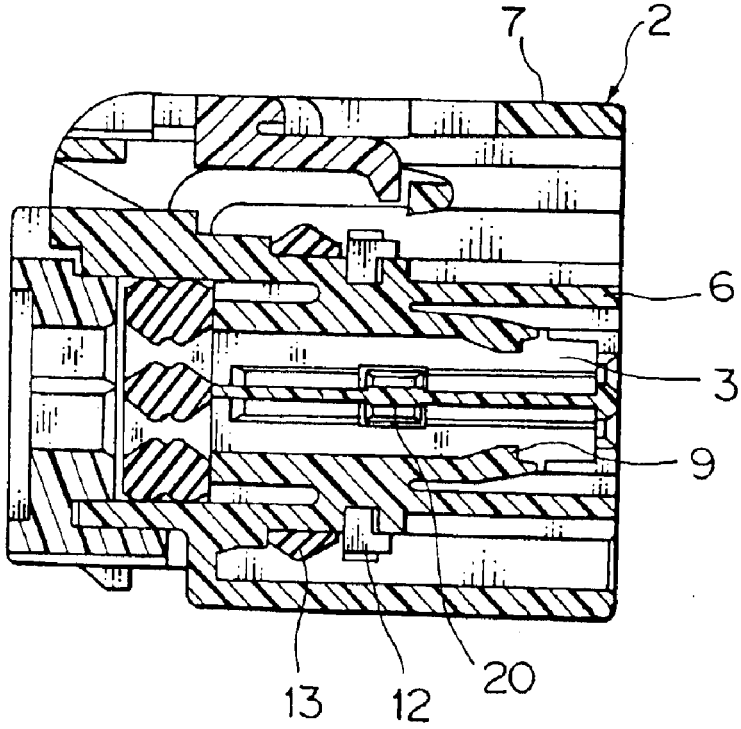
FIG. 3 is a sectional side view showing the connector housing.
Figure 8:
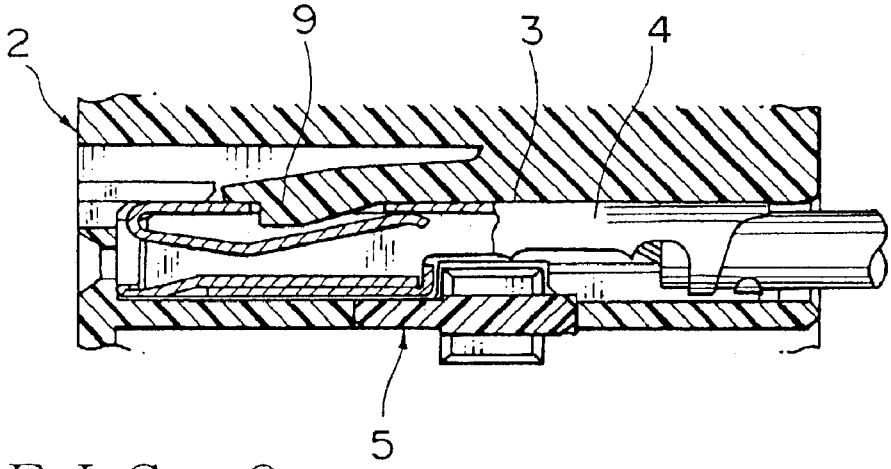
FIG. 8 is a section view showing a state in which a terminal accommodating chamber accommodates a connector terminal according to the present invention.

Now, an embodiment according to the present invention will be described in detail referring to the drawings. FIG. 1 shows one embodiment of an electrical connector according to the present invention. In the connector 1, as shown in FIG. 3 and FIG. 8, a connector terminal 4 accommodated in a terminal accommodating chamber 3 of a connector housing 2 is locked with a spacer 5 (side spacer) that is a locking member.

As shown in FIG. 1, FIG. 3 and FIG. 5 to FIG. 7, the connector housing 2 is made of synthetic resin, and has a housing body 6 and a hood portion 7. The housing body 6 has a substantially rectangular section. The hood portion 7 has a cylindrical shape open at its front portion, surrounding a side portion of the housing body 6 with a specified interval. A space between the hood portion 7 and the housing body 6 is formed as an engagement portion 8 with which another connector housing (not shown) is engaged. A seal member 13 is provided around the entire periphery of an outer surface (outer wall) of the housing body 6, deeper from a center of the engagement portion 8. When another connector is engaged with the connector housing 2, the space between such other connector and the housing body 6 is to be sealed.

A plurality of terminal accommodating chambers 3 are provided inside the housing body 6 in two stages, upper and lower, side by side. Each terminal accommodating chamber 3 is formed as a square hole with a rectangular section so that the connector terminal 4 is inserted thereto from a rear side of the connector housing 2. Additionally, the terminal accommodating chamber 3 is provided with a lance 9 resiliently, and configured as to prevent the connector terminal 4 engaged with the lance 9 from shifting toward a front side in the direction of the insertion thereof. The lance 9 engages with the connector terminal 4 to prevent an ejection of the connector terminal 4.

A spacer insertion hole 10 is provided on one side surface of the hood portion 7. The spacer insertion hole 10 is a locking member insertion hole where the spacer 5 is inserted into the hood portion 7 (connector housing 2) and attached with the housing body 6. Guide grooves 11 are formed from one end to the other end continuously on upper and lower surfaces of the housing body 6, respectively. The guide groove 11 with a concave section guides the spacer 5 in a direction substantially orthogonal to a direction of the connector terminal 4 insertion. (The direction of the connector terminal 4 insertion is a longitudinal direction of the housing body 6) The width of a pair of guide grooves 11 is formed to be a little wider than the width of the pair of fitting pieces 12 of the spacer 5, or to be so wide as to accept a part of the fitting piece 12. If the width of the guide groove 11 is formed to be a little wider than that of the fitting piece 12, preferably, a depth of the guide groove 11 is substantially as thick as a thickness of the fitting piece 12. In this case, the guide groove 11 may be provided with a greater depth extending along the longitudinal direction thereof along one side wall thereof and formed with a L-shape bottom. This deeper guide groove functions the same as the guide groove 11 that is formed so wide as to accept the part of the fitting piece 12. In this embodiment described below, the width of the guide grooves is formed to accept the part of the fitting piece 12 (guide piece).

Additionally, a locking portion 16 is provided around each guide groove 11 on upper and lower faces of the housing body 6. The locking portion 16 has a temporary locking groove 14 and a final locking groove 15, both of which are formed successively in the direction of the spacer 5 insertion. A width of the temporary locking groove 14 and the final locking groove 15 is designed optionally according to the engagement portion of the spacer 5, for example, over the width of the fitting piece 12. A wall portion is formed along the direction substantially orthogonal to the direction of the spacer 5 insertion at a rear side of the temporary-locking groove 14. Therefore, it is difficult to shift a below-described engagement projection 24 to an opposite direction to the spacer 5 insertion direction when the engagement projection 24 is in the temporary-locking groove 14. Additionally, a front side of the temporary locking groove 14 is so inclined as to allow the engagement projection 24 to be shifted in the direction of the spacer 5 insertion. The final locking groove 15 is disposed adjacent to the temporary-locking groove 14. A rear side of the final locking groove 15 in the insertion direction is inclined.

In about a middle of one side surface of the housing body 6, a through hole 17 is provided extending along a direction orthogonal to the longitudinal direction of the housing body 6, penetrating the housing body 6. The through hole 17 is disposed between two stages, upper and lower, side by side of the terminal accommodating chamber 3, and formed across a part of each terminal accommodating chamber 3 disposed above and below the through hole 17.

The spacer 5 is, as shown in FIG. 1, FIG. 3 to 5 and FIG. 9, made of synthetic resin, and composed of a spacer body 19 and a terminal locking portion 20. The spacer body 19 has a pair of fitting pieces 12 and a connecting portion 18 connected to ends of the fitting pieces 12, and has a substantially horseshoe shaped section. The terminal locking portion 20 is provided in a middle of the connecting portion 18 of the spacer body 19, substantially parallel to the pair of fitting pieces 12. Thus, the spacer 5 is formed with an E-shape section.

The terminal locking portion 20 is formed in a plate shape, being inserted into the through hole 17 of the housing body 6 freely attachable and detachable. Additionally, the terminal locking portion 20 is formed so long that an end thereof faces around an opening of an opposite-to-insertion side of the through-hole 17 when inserting into the through-hole 17. A plurality of locking pieces 21 are provided in each upper and lower surfaces of the terminal locking portion 20 with a specified interval. When the terminal locking portion 20 is inserted into the through-hole 17, by engaging with the connector terminal 4 accommodated in terminal accommodating chamber 3, a locking piece 21 prevents the connector terminal 4 from ejecting from the terminal accommodating chamber 3.

The spacer body 19 is formed with a substantially horseshoe shaped section, composed of the pair of the fitting pieces 12 and a connecting portion 18, and supports the fitting pieces 12 resiliently. Each fitting piece 12 is formed in a plate shape of which width is a little wider than that of the terminal locking portion 20, and facing each other substantially parallel. The connecting portion 18 is formed substantially the same width as the fitting pieces 12 with a plate shape, and connected to both ends of the pair of fitting pieces 12.

Thicknesses of the pair of fitting pieces 12 and the connecting portion 18 are determined optionally in a range so as to allow the other (mating) connector housing to be inserted into the engagement portion 8 when the spacer 5 is attached to the housing body 6.

The length of the connecting portion 18 is formed a little longer than a height of the housing 6. Therefore, when the spacer 5 is attached to the housing body 6, the connecting portion 18 abuts against the side portion of the housing body 6 to hold the housing body 6 by the fitting pieces 12 sandwiching the housing body 6 from above and below. A connecting portion insertion groove accommodating a part or a whole of the connecting portion 18 may be provided on a side portion 22 of the housing body 6 against which the connecting portion 18 abuts. By providing the connecting portion insertion groove in this manner, when the spacer 5 is attached to the housing body 6, the spacer 5 is inserted into the guide groove 11 and the connecting portion insertion groove allows the other (mating) connector housing to be engaged with the engagement portion 8 easily.

A guide piece 23 to be guided into the guide grooves 11 is provided upright on one of left and right side-end portions in each of upper and lower facing surfaces (surfaces abutting against the housing body 6) of the fitting pieces 12. Thus, the fitting piece 12 is formed with an approximately L-shape section. A height from the substantially middle to the end portion of the guide piece 23 is formed higher, while the end portion thereof projects from the fitting piece 12 in its longitudinal direction.

Figure 9:
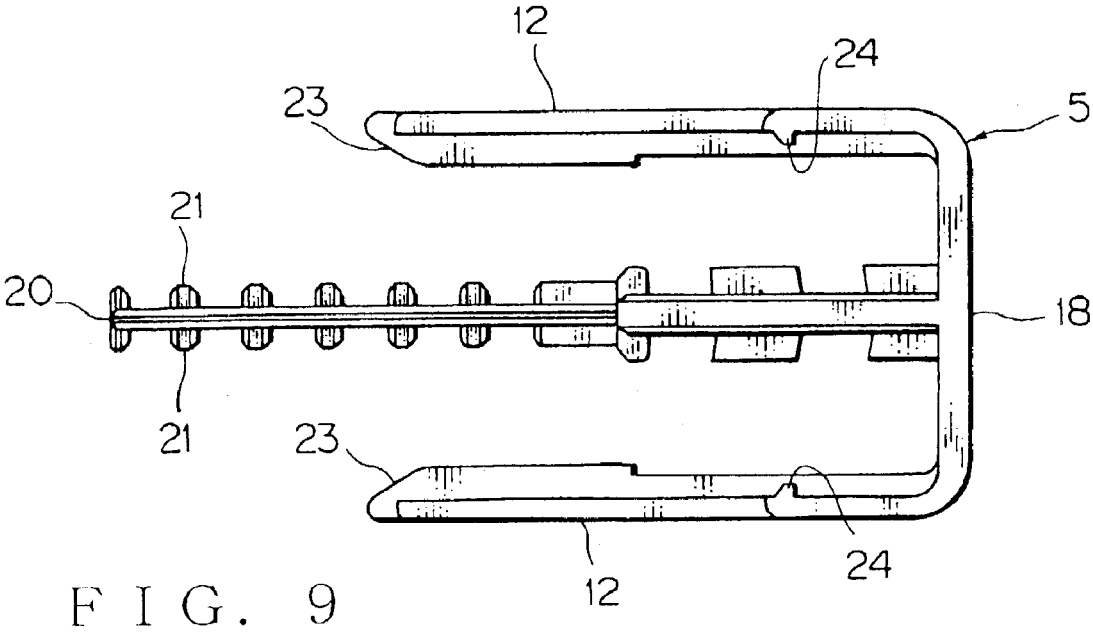
FIG. 9 is a side view showing the spacer according to the present invention.
Figure 5:
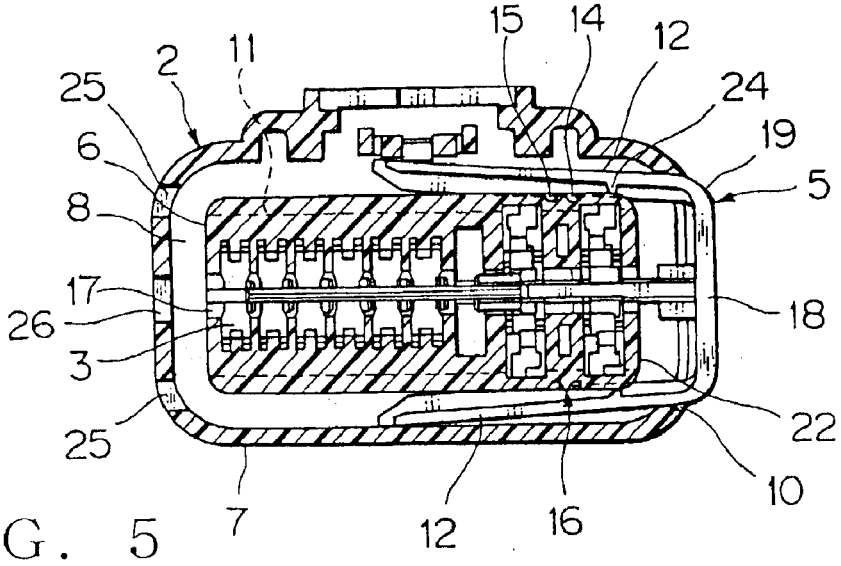
FIG. 5 is a section view showing a state in which a spacer is fitted into the connector housing according to the present invention.

A length of the fitting pieces 12 is designed optionally within a width of the housing body 6. For example, as shown in FIG. 1, FIG. 5, and FIG. 9, the length is designed shorter than the terminal locking portion 20.

The engagement projection 24 is formed on the each opposite surface of the pair of the fitting piece 12, extending in a width direction thereof, to engage with the locking portion 16 of the housing body 6 as a engagement portion. A connecting portion side of the engagement projection 24 is provided with a vertical wall portion extending orthogonal to the direction of the spacer 5 insertion. Additionally, an end portion side of the engagement projection 24 is provided with an inclined portion so as to shift the engagement projection 24 forward easily. The engagement projection 24 is so disposed that, when engaging with the temporary locking groove 14 of the locking portion 16 in the housing body 6, the spacer 5 is located at the temporary locking position and the connector terminal 4 is able to be inserted in the terminal accommodating chamber 3, while when engaging with the final locking groove 15, the connector terminal 4 accommodated in the terminal accommodating chamber 3 engages with the locking piece 21 of the terminal locking portion 20 to prevent the connector terminal 4 from ejecting from the terminal accommodating chamber 3.

As described above, the housing body 6 is provided with the locking portion 16 composed of the temporary locking groove 14 and the final locking groove 15, while each of the fitting pieces 12 is provided with the engagement projection 24. Alternatively, the housing body 6 may be provided with the engagement projection 24, while each fitting piece 12 may be provided with the locking portion 16 which is composed of the temporary locking groove 14 and the final locking groove 15.

A side surface in the hood portion 7 opposite to the side surface provided with a spacer insertion hole 10, as shown in FIG. 1, FIG. 2, and FIGS. 5 to 7, is pierced to provide two engagement release holes 25 and one extrusion hole 26.

Figure 2:
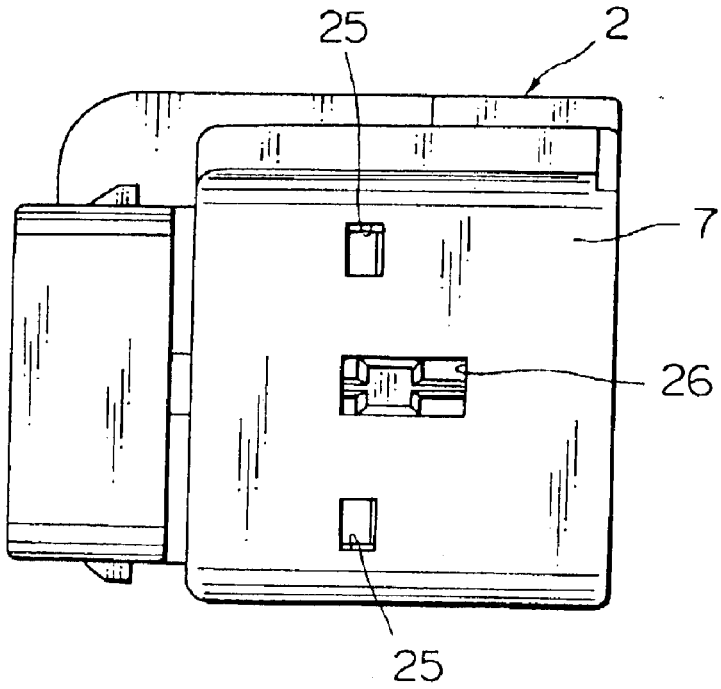
FIG. 2 is a side view showing a connector housing according to the present invention.

Through the engagement release hole 25, engagement release tool 27 is inserted into the connector housing 2 from a direction opposite to the direction of the spacer 5 insertion, deflecting the fitting piece 12 to release an engagement of the engagement projection 24 of the fitting piece 12 with the locking portion 16 of the housing body 6. The engagement release hole 25 is not limited as long as the engagement release tool 27 can be inserted thereto, for example, as shown in FIG. 1 and FIG. 2, The engagement release hole 25 is formed a rectangular/square hole.

Figure 4:
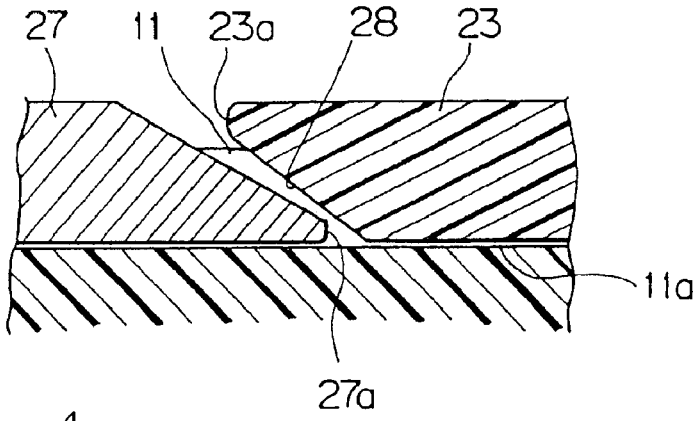
FIG. 4 is a partial section view showing a state in which an engagement release tool is inserted into a guide groove according to the present invention.

Any means may be employed for releasing the engagement using the engagement release tool 27, as long as the engagement release tool 27 deflects the fitting piece 12 directly to release the engagement. For example, an end portion of the engagement release tool 27 may be inserted into a hole, which is provided at the end portion of the fitting piece 12 by piercing. Then the end portion of the engagement release tool 27 may be shifted to a direction of removing from the housing body 6 to release the engagement. Preferably, as shown in FIG. 4, the end portion of the engagement release tool 27 is inserted into a clearance between the fitting piece 12 and the housing body 6 to deflect the fitting piece 12.

Specifically, for example, the engagement release tool 27, which is formed optionally according to the guide piece 23, is formed to engage with only the guide piece 23 which is a part of the fitting piece 12. Preferably, the end portion of the engagement release tool 27 is formed in a rectangular shape. A width of the end portion of the engagement release tool 27 is not limited, but preferably formed about the same as the width of guide piece 23 to insert the engagement release tool 27 into the guide grooves 11 for releasing the engagement. A height of the engagement release tool 27 is not limited, but preferably a size to insert the engagement release tool 27 between the end 23*a* of the guide piece 23 and the housing body 6 (bottom wall 11*a* of the guide grooves 11) easily. Preferably, a housing body side surface of the engagement release tool 27 is formed in a plane shape. Additionally, as for the opposite surface of the housing body side surface (engagement surface), a plane shape surface is acceptable. However preferably, an inclined portion of which the height is gradually higher from the end to a rear side is provided on the engagement surface.

Preferably, an inclined portion 28 of which height is gradually higher from its end to its rear side is provided at an end portion of an opposite surface (surface abutting against the housing body) of the guide piece 23. Namely, preferably, the inclined portion 28 is so provided at the end 23*a* of the guide piece 23 that when the guide piece 23 is inserted into the guide grooves 11, a gap (space) is generated between the end 23*a* of the guide piece 23 and the bottom wall 11*a* of the guide grooves 11. Thus, the end 27*a* of the engagement release tool 27 is allowed to be inserted into the gap, as shown in FIG. 4. When the end 27*a* of the engagement release tool 27, which is inserted into the gap, abuts against the inclined portion 28, the end 23*a* of the guide piece 23 shifts upward from the guide grooves 11. Furthermore, when the engagement release tool 27 is inserted, the end 23*a* of the guide piece 23 gradually shifts to remove upward from the guide groove. Lastly, the engagement projection 24 of the fitting piece 12 removes gradually from the locking portion 16 of the housing body 6 to release the engagement.

As shown in FIG. 1, FIG. 2, and FIGS. 5 to 7, an extrusion tool 29 is inserted through the extrusion hole 26 from a direction opposite to the direction of the spacer 5 insertion to extrude the spacer 5 toward the rear side of the direction of the spacer 5 insertion. A shape of the extrusion hole 26 is not limited, as long as the extrusion tool 29 can be inserted through it. For example, as shown in FIG. 1 and FIG. 2, the extrusion hole 26 is formed in a rectangular shape.

The extrusion tool 29 extrudes the spacer 5 in a direction opposite to the direction of the spacer 5 insertion. For example, the extrusion tool 29 is allowed to abut against the end portion of the terminal locking portion 20 and insert through the through hole 17 at once. In this case, the hood portion 7 is pierced to provide the extrusion hole 26 at a front side of the direction of the spacer insertion of the through hole 17.

The extrusion tool 29 and the engagement release tool 27 may be formed integrally as one tool, or may be formed separately.

Now, for attaching the spacer 5 to the connector housing 2, firstly the spacer 5 is inserted from a transversal direction of the connector housing 2 (substantially orthogonal to the longitudinal direction of the connector housing 2) through the spacer insertion hole 10 into the connector housing 2. As for this insertion, the terminal locking portion 20 of the spacer 5 is inserted into the through hole 17 of the housing body 6, then the guide piece 23 of each fitting piece 12 is inserted into the associated guide groove 11 of the housing body 6. Hereat, since the pair of the fitting pieces 12 of the spacer 5 are formed with a substantially L-shaped section, the spacer 5 cannot be inserted upside down, and can be inserted just with a correct position.

Figure 6:
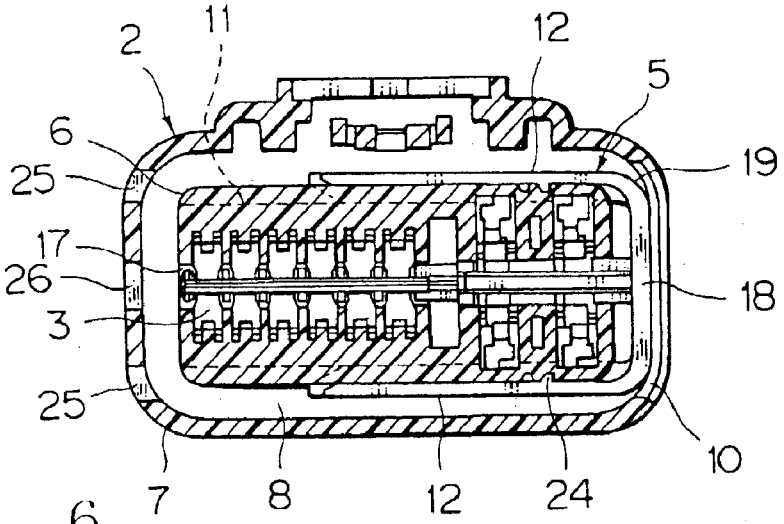
FIG. 6 is a section view showing a state in which the spacer is temporarily locked according to the present invention.

With the correct position of the spacer 5, the guide piece 23 is inserted into the guide grooves 11, then pressing the spacer 5 into connector housing 2. Then, firstly as shown in FIG. 5, the engagement projection 24 reaches an outer wall of the housing body 6, running onto the wall to open the end portion of each fitting piece 12. Next, when the engagement projection 24 enters into the temporary locking groove 14, as shown in FIG. 6, the end portion of each fitting piece 12 restores resiliently and the pair of the fitting pieces 12 restores substantially in parallel together. Thus, the spacer 5 is held at the temporary locking position.

In this state, the connector terminal 4 is inserted from the rear side of the connector housing 2 into the terminal accommodating chamber 3. When the connector terminal 4 reaches a regular position in the terminal accommodating chamber 3, a further forward shift in the direction of the insertion is prevented, while a backward shift is prevented by a lance 9.

Figure 7:
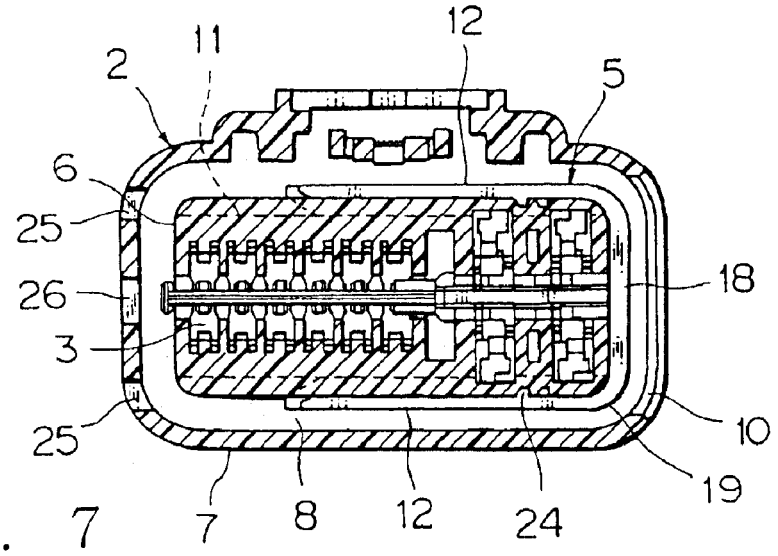
FIG. 7 is a section view showing a state in which the spacer is finally locked according to the present invention.

After inserting the connector terminal 4, when the spacer 5 is further pressed, the engagement projection 24 climbs over a wall which composes the temporary locking groove 14, as shown in FIG. 7, entering into the final locking groove 15 to hold the spacer 5 at the final locking position. When the spacer 5 is held in the final locking position, each locking piece 21 of the terminal locking portion 20 of the spacer 5 is positioned at each terminal accommodating chamber 3, engaging with the connector terminal 4 which is accommodated in the terminal accommodating chamber 3. Thus, each locking piece 21 is positioned at each terminal accommodating chamber 3 to prevent the connector terminal 4 from ejecting from the terminal accommodating chamber 3.

Thus, two members, the lance 9 and the spacer 5, are employed for preventing the connector terminal 4 from ejecting. Therefore, the connector terminal 4 is prevented from ejecting from the terminal accommodating chamber 3 reliably.

Additionally, by attaching the spacer 5 to the housing body 6, the spacer 5 is employed as a removal prevention portion of the seal member 13 which is provided around the entire periphery of an outer surface (outer wall) of the housing body 6.

For ejecting the spacer 5 from the connector housing 2, as shown in FIG. 1, FIG. 2, and FIGS. 5 to 7, each engagement release tool 27 is inserted into each of two engagement release holes 25. Then the end 27*a* of the engagement release tool 27 is inserted into the guide grooves 11 so that a rear surface of the end 27*a* contacts the bottom wall 11*a* of the guide grooves 11. In this state, when the engagement release tool 27 is pressed (inserted) into the hood portion 7, an end 27*a* of the engagement release tool 27 is inserted into the gap (space) formed between the end 23*a* of the guide piece 23 and the bottom wall 11*a* of the guide grooves 11. Then, the end 27*a* abuts against the inclined portion 28 of the guide piece 23, as shown in FIG. 4. When pressing the engagement release tool 27 further, the end 27*a* of the engagement release tool 27 penetrates between the guide piece 23 and the bottom wall 11*a* of the guide grooves 11, pressing up the end 23*a* of the guide piece 23 upward from the guide grooves 11 gradually. When the end 23*a* of the guide piece 23 reaches the specific height, the engagement projection 24 of the fitting piece 12 disengages from the locking portion 16 of the housing body 6, so that the engagement between the locking portion 16 of the housing body 6 and the engagement projection 24 is released.

Thus, the engagement release tool 27 is inserted from the direction opposite to the direction of the spacer 5 insertion, and the end 27*a* is inserted into a clearance between the guide piece 23 and the bottom wall 11*a* of the guide grooves 11. Therefore, a contact area between the guide piece 23 and the engagement release tool 27 is larger than other cases, for example, inserting an engagement releasing tool in a direction orthogonal to the longitudinal direction of the spacer 5. This allows the engagement release tool to contact the guide piece 23 reliably. Additionally, the fitting piece 12 is so deflected by inserting the engagement release tool 27 that the engagement between the engagement projection 24 and the locking portion 16 of the housing body 6 is released. Therefore, the engagement release tool 27 directly deflects the fitting piece 12 that is involved with the engagement, without any intermediate member such as the connecting portion 18. Therefore, it is possible to release the engagement of the spacer 5 easily.

Additionally, by inserting the end 27*a* of the engagement release tool 27 between the guide piece 23 and the bottom wall 11*a* of the guide grooves 11, the fitting piece 12 is deflected to release the engagement. Therefore, it is possible to release the engagement of the spacer 5 with an easy structure.

Moreover, providing the inclined portion 28 at the end portion of the guide piece 23 helps the engagement release tool 27 to be inserted into a clearance between the guide piece 23 and the bottom wall 11*a* of the guide grooves 11. Therefore, it is possible to release the engagement of the spacer 5 easier.

Additionally, by inserting the engagement release tool 27 into the guide grooves 11, the end 27*a* of the engagement release tool 27 is guided along the guide grooves 11 to between the end 23*a* of the guide piece 23 and the bottom wall 11*a* of the guide grooves 11. Therefore, the end 27*a* of the engagement release tool 27 is inserted into a clearance between the guide piece 23 and the guide grooves 11 reliably, to allow the engagement of the spacer 5 to be released still easier.

The extrusion tool 29 is inserted into the extrusion hole 26, before or after the engagement between the locking portion 16 of the housing body 6 and the engagement projection 24 is released by inserting the engagement release tool 27. After releasing the engagement, the end portion of the extrusion tool 29, which is inserted through the extrusion hole 26, abuts against and is pressed (inserted) into the end portion of the terminal locking portion 20. Then, the terminal locking portion 20 is pressed in the direction opposite to the direction of the spacer 5 insertion. At this moment, preferably, the engagement release tool 27 is also inserted into the hood portion 7 along with the extrusion tool 29.

Since the engagement has been released, the spacer 5 (terminal locking portion 20), which is pressed by the extrusion tool 29, is shifted (extruded) easily. Then the engagement projection 24 shifts to the spacer insertion hole side from the locking portion 16. When the connecting portion 18 projects enough to be picked up with fingers, the insertion of the extrusion tool 29 is stopped. Thus, the spacer 5 is easily ejected from the spacer insertion hole 10. Additionally, it is acceptable for the spacer 5 to be pressed by the extrusion tool 29 until the spacer 5 is fully separated from the spacer insertion hole 10.

Thus, the spacer released from the engagement by the engagement release tool 27 can be extruded by the extrusion tool 29 to be ejected easily.

Moreover, when the engagement is released by inserting the engagement release tool 27, an abutting portion against which the end 27*a* of the engagement release tool 27 abuts may be provided on the opposite surface of the guide piece 23. Or the abutting portion against which the end 23*a* of the guide piece 23 abuts may be provided on the engagement release tool 27. By providing the abutting portion in this manner, when the engagement release tool 27 is inserted further after releasing the engagement, the guide piece 23 is extruded through the abutting portion toward the front side of the direction of the engagement release tool 27 insertion. Therefore, in this case, the engagement release tool 27 works same as the extrusion tool 29 to allow the spacer 5 to be picked up easily. In this case, said extrusion hole and said extrusion tool is unnecessary.

Moreover, the engagement release tool 27 and the extrusion tool 29 are inserted into the hood portion 7 in a direction substantially orthogonal to the longitudinal direction of the housing body 6 (the connector terminal 4 accommodating direction). Therefore, the seal member 13 provided in engagement portion 8 may not be damaged by the insertion. Namely, when an ejection tool is inserted into the engagement portion 8 to shift the spacer 5, the seal member 13 may be damaged by contacting with the ejecting tool which is inserted too much further. However, there is no fear of damaging the seal member 13 in this manner.

Although the present invention has been fully described by way of examples with reference to the accompanying drawings, it is to be noted that various changes and modifications can be made in a scope of the present invention.

What is claimed is:

1. An electrical connector comprising:

a connector housing having a locking member insertion hole and an engagement release hole for inserting an engagement release tool, said connector housing accommodating a connector terminal; and a locking member having a fitting piece and an engagement portion, said fitting piece being supported resiliently by the locking member, said engagement portion being provided on the fitting piece, whereby the locking member is inserted through the insertion hole into the connector housing to engage the connector housing with the engagement portion and lock the connector terminal, wherein the release tool is inserted through the release hole into the connector housing in a direction opposite to an insertion direction of the locking ember to deflect the fitting piece and release the engagement between the engagement portion and the connector housing, said connector housing further comprising a housing body and a housing hood, said housing body having a rectangular section, said housing body accommodating the connector terminal, said housing body of which two outer walls opposite to each other having respectively two locking portions, said locking portions engaged with the engagement portions of the locking member, said each outerwall having a guide groove in a direction perpendicular to an insertion direction of the connector terminal, said housing hood surrounding the housing body with a specified interval, wherein the locking member is formed having a substantially U-shape cross section by the pair of fitting pieces and a connecting portion, each of said fitting pieces having the engaging portion and a guiding piece on a surface opposite to each other, said guiding piece being inserted into and guided along the guide groove, said connecting portion connecting the pair of fitting pieces resiliently, wherein the pair of release holes are provided on the connector hood forward in the insertion direction of the locking member along the guide groove, and an end of the release tool is inserted through the release hole into the guide groove and guided between an end of the guiding piece and the housing body.

2. The electrical connector as claimed in claim 1, of which connecting portion further comprises a terminal locking portion, said terminal locking portion being extended substantially parallel to the pair of fitting pieces and locks the connector terminal, said electrical connector, the housing body of which further comprising an elongated opening and an extrusion hole, said elongated opening through which the terminal locking portion is inserted extending through said housing body, said extrusion hole, through which an extrusion tool portion of the release tool is inserted, being provided on the connector hood forward in an insertion direction of the terminal locking portion, said extrusion tool portion abutting and shifting an end of the terminal locking portion backward in the insertion direction of the terminal locking portion, said extrusion tool portion being inserted into the elongated opening.

3. An electrical connector comprising:

a housing having a housing body enclosed within said housing and containing chambers operative to accommodate at least one connector terminal therein, a locking member for locking the connector terminal in its associated chamber including a resilient fitting piece, a terminal locking portion extending substantially parallel to said fitting piece and a connecting portion joining said fitting piece to said terminal locking portion, guide means in said housing body for insertion of said locking member, said guide means extending orthogonally with respect to said terminal chamber and including a guide groove disposed on a wall of said housing body and an elongated opening extending through said housing body in spaced relation to said guide groove and intersecting said terminal chamber, an opening on one side of said housing for accessing said locking member with said guide means in said housing body, and engagement release holes on a side of said housing opposite said opening and being laterally aligned with said guide groove and said elongated opening, said release holes being operative to receive an engagement release tool for engaging said locking member and pushing it from said connector.

4. The electrical connector as claimed in claim 3 including an engagement projection carried by said fitting piece and a pair of spaced recesses adjacent said guide groove to selectively receive said engagement projection in a temporary locking position or a final locking position.

5. The electrical connector as claimed in claim 4, wherein an end portion of the engagement release tool is inserted into a clearance between the guide groove and an end portion of said fitting piece, on which the engagement projection is provided, to deflect the fitting piece and release the engagement between the engagement projection and the recess on the connector housing.

6. The electrical connector as claimed in claim 5 in which the fitting piece further comprises an inclined portion at an end thereof, and wherein, when the fitting piece is engaged in the guide groove of the connector housing a space is formed by the inclined portion, the connector housing and the fitting piece, and the end portion of the release tool cooperates with said space in releasing the engagement between the engagement projection and the recess on the connector housing.

7. The electrical connector as claimed in claim 5 in which the fitting piece further comprises an abutting portion, wherein the end portion of the release tool abuts the abutting portion to engage the terminal locking portion to shift the locking member backward in an insertion direction of the locking member after releasing the engagement between the engagement projection on said fitting piece and the recess on the connector housing.

8. The electrical connector as claimed in claim 5, wherein an abutting portion is provided on the release tool for abutting an end portion of the fitting piece to shift the locking member backward in an insertion direction of the locking member after releasing the engagement between the engagement projection on said fitting piece and the recess on the connector housing.

9. The electrical connector as claimed in claim 3, including an extrusion hole in the housing for inserting an extrusion tool portion of said engagement release tool, said extrusion tool being inserted through the extrusion hole to shift the locking member backward in the insertion direction of the locking member.

* * * * *